United States Patent [19]

Wessel et al.

[11] 4,147,146

[45] Apr. 3, 1979

[54] FUEL SUPPLY SYSTEM

[75] Inventors: Wolf Wessel, Oberriexingen; Wolfgang Ripper, Stuttgart, both of Fed. Rep. of Germany

[73] Assignee: Robert Bosch GmbH, Stuttgart, Fed. Rep. of Germany

[21] Appl. No.: 769,495

[22] Filed: Feb. 17, 1977

[30] Foreign Application Priority Data

Feb. 24, 1976 [DE] Fed. Rep. of Germany ..... 2607366

[51] Int. Cl.[2] ..... F02M 39/02

[52] U.S. Cl. ..... 123/139 AW; 261/50 A

[58] Field of Search ..... 123/139 AW, 139 BG, 123/119 R; 261/50 A, 44 R, 44 A

[56] References Cited

U.S. PATENT DOCUMENTS

| | | | |
|---|---|---|---|
| 1,715,453 | 6/1929 | Goddyn | 261/44 R |
| 1,839,102 | 12/1931 | Kessel | 261/44 A |
| 1,981,483 | 11/1934 | Weber | 261/44 R |
| 2,798,705 | 7/1957 | Lawrence, Sr. | 261/44 R |
| 3,809,036 | 5/1974 | Knapp et al. | 261/50 A |
| 3,983,856 | 10/1976 | Stumpp et al. | 123/139 AW |
| 4,015,571 | 4/1971 | Stumpp | 123/139 AW |

FOREIGN PATENT DOCUMENTS

| | | | |
|---|---|---|---|
| 2307136 | 5/1976 | France | 123/139 AW |

*Primary Examiner*—Charles J. Myhre
*Assistant Examiner*—P. S. Lall
*Attorney, Agent, or Firm*—Edwin E. Greigg

[57] ABSTRACT

A fuel supply system for an internal combustion engine includes an airflow metering device in the induction manifold which directly actuates a fuel metering valve formed by cooperating parts of the airflow meter bushing and the shaft around which it pivots. A differential pressure valve holds the pressure drop across the fuel metering aperture constant. Bimetallic springs are provided to exert temperature dependent forces on the diaphragm in the differential pressure valve to increase the differential pressure when the engine is cold.

2 Claims, 4 Drawing Figures

FUEL SUPPLY SYSTEM

BACKGROUND OF THE INVENTION

The invention relates to a fuel injection mechanism for mixture compressing, externally ignited internal combustion engines, particularly one provided with an injection location in the air induction line, within which are consecutively disposed an airflow measuring element and an arbitrarily manipulatable throttle valve. The airflow measuring element is moved in accordance with the airflow rate and against a restoring force, thereby displacing the movable component of a fuel valve for the apportionment of a fuel quantity proportional to the air quantity, the fuel valve being located within the rotating shaft of the air measuring element.

The pressure difference across the fuel valve is held constant by a differential pressure valve constructed as a flat seat valve having a membrane as movable valve member. One surface of the membrane experiences fuel pressure from upstream of the metering valve while the other surface is exposed to fuel pressure prevailing downstream of the metering valve and additionally the force of a spring.

Fuel injection mechanisms of this kind have the purpose of automatically producing a favorable fuel-air mixture for all of the operational conditions of the internal combustion engine, in order to effect the complete combustion of the fuel, and thereby to avoid or at least reduce greatly the formation of noxious exhaust gas constituents, in conjunction with the highest possible outpt of the internal combustion engine, or the least possible fuel consumption. The fuel quantity must therefore be very precisely apportioned in correspondence to the requirements of each given operational condition of the internal combustion engine.

In known fuel injection systems of this type, an enriched fuel-air mixture is obtained during the warm-up phase of the engine by providing a bimetallic spring which engages the differential pressure valves and causes an increase of the differential pressure during warm-up. Inasmuch as shortly after the engine has started, the cylinder walls become warm and any fuel condensation no longer takes place, it is suitable for the purpose of fuel economy and for a reduction of the toxic exhaust gas components to reduce the fuel enrichment somewhat so as to obtain smooth and optimum operation of the engine.

OBJECT AND SUMMARY OF THE INVENTION

It is an object of the present invention to develop a fuel injection mechanism of the above described type, with which, however, an improved accommodation to the requirements of the internal combustion engine during the warm-up phase is assured.

This object is attained, according to the invention, by providing that the differential pressure is increased during the warm-up phase of the engine. This increase is obtained by disposing a first and a second bimetallic spring the forces of which act in the closure direction of the membrane within the differential pressure valve. After a previously determined operational temperature is reached, the first bimetallic spring is made inactive and after reaching the termination of the warm-up phase of the engine, the second bimetallic spring is disengaged from the membrane.

The invention will be better understood as well as other objects and advantages thereof become more apparent from the following detailed description of the invention taken in conjunction with the drawing.

DESCRIPTION OF THE PREFERRED EMBODIMENT

Figure 1:
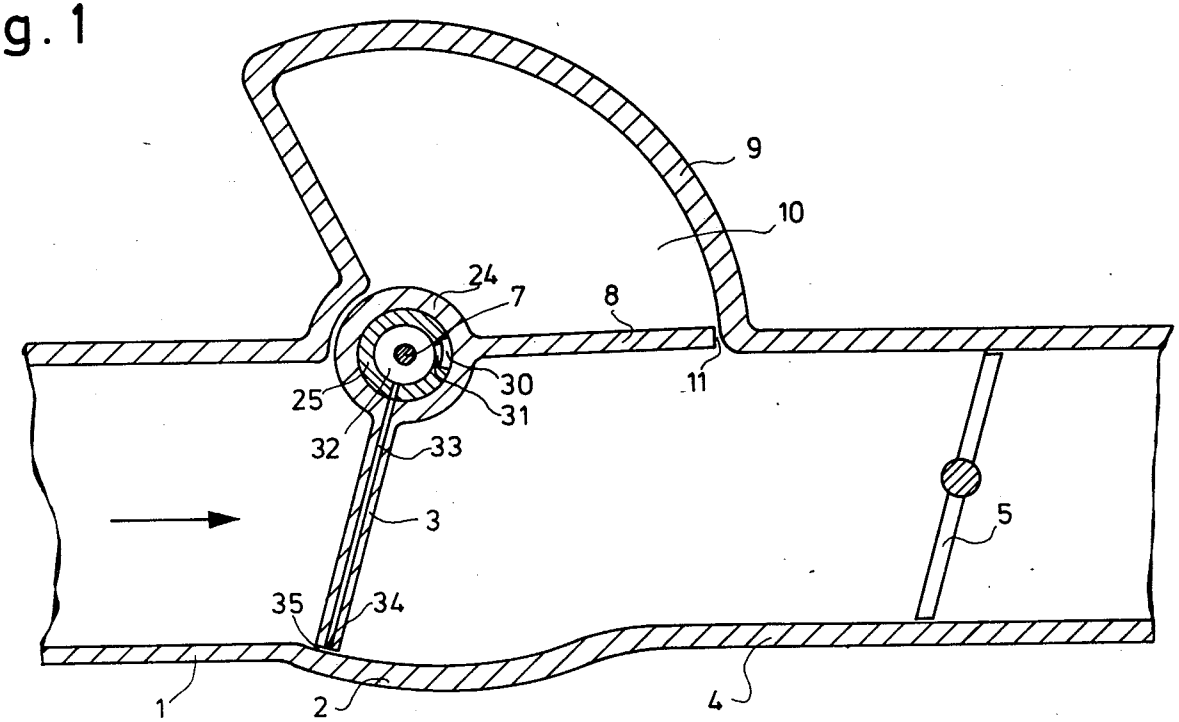
FIG. 1 is a section through a fuel injection mechanism along the line I—I in FIG. 2.

In the fuel injection mechanism represented in FIG. 1, the combustion air flows in the direction of the arrow into an air induction line 1, which is provided with a curved section 2 containing a measuring element constructed as a barrier valve 3, and further flows through a section 4 containing an arbitrarily manipulatable throttle valve 5 and into one or several cylinders (not shown) of an internal combustion engine. The measuring element constructed as the barrier valve 3 moves within the complementally formed section 2 of the air induction line 1 as a nearly linear function of the air quantity flowing through the air induction line in which, for a constant air pressure prevalent upstream of the measuring element 3, the air pressure prevailing between the measuring element and the throttle valve 5 likewise remains constant. The measuring element 3 is pivotal about a fixed bearing axle 7 disposed transversely relative to the air induction line, and it is provided with a damping valve 8. The damping valve 8 can travel into a damping section 9 of the air induction line during an opening movement of the measuring element 3. The chamber 10 formed by the damping valve 8 and the damping section 9 communicates with the air induction line downstream of the measuring element 3 via a small gap 11 that is provided between the extremity of the damping valve 8 and the opposing wall of the damping section 9. It is a result of the incorporation of the damping valve 8 that the induction tube pressure fluctuations evoked by the suction strokes have practically no influence upon the angular positioning of the measuring element 3.

Figure 2:
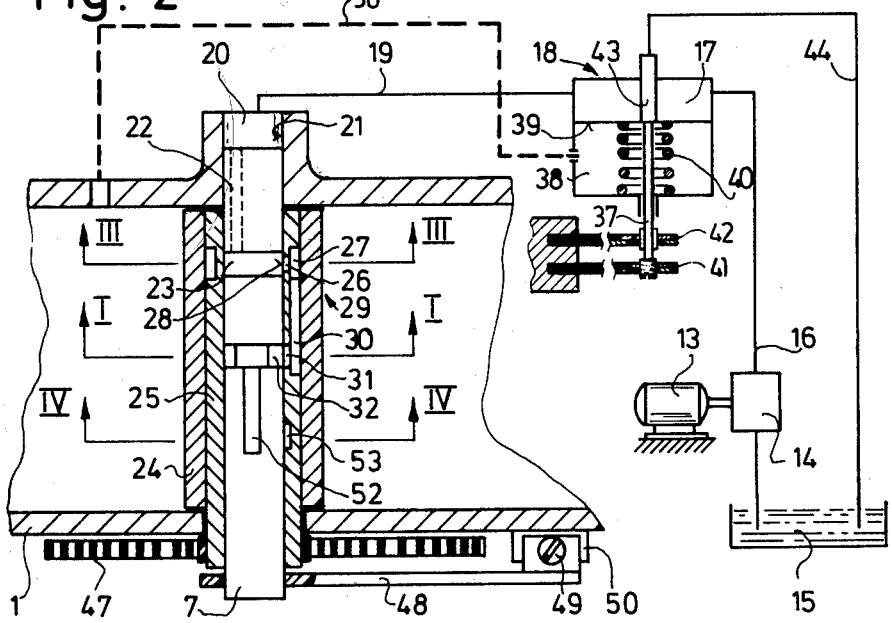
FIG. 2 shows a schematic view of the fuel injection mechanism associated with the valving structure.
Figure 3:
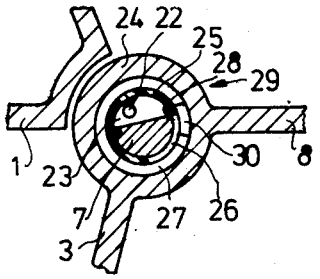
FIG. 3 is a sectional view of the fuel injection mechanism along the line III—III of FIG. 2.

As depicted in FIG. 2, the supplying of the fuel takes place by means of a fuel pump 14 driven by an electric motor 13, which fuel pump 14 pumps fuel from a fuel container 15 and delivers the same to the chamber 17 of a differential pressure valve 18 via a line 16. From the chamber 17 the fuel travels to a chamber 20 via a line 19, which chamber 20 is formed by the end face of the bearing axle 7 and the guide boring 21 of the bearing axle 7. The chamber 20 communicates with a notch 23 machined into the bearing axle 7, via a boring 22 depicted in FIG. 2 by dashed lines. The measuring element 3 and the damping valve 8 are integrally disposed upon a carrier body 24, which is firmly attached to a sleeve 25 which is rotatably supported around the bearing axle 7. The sleeve 25 incorporates a control slit 26 which leads to an annular groove 27. The control slit 26 cooperates with a control edge 28 (FIGS. 3), which is formed by boundary surface of the notch 23 of the bearing axle 7. The control slit 26 is opened more or less according to the given attitude of the measuring element 3 by means of the control edge 28, so that a proportional fuel quantity can be apportioned relative to the air quantity aspirated by the internal combustion engine. The control edge 28 and the control slit 26 cooperate with a sleeve-like apportioning valve 29 disposed about the bearing axle 7 of the measuring element 3. From the annular groove 27, the apportioned fuel reaches an annular groove 32 of the bearing axle 7 via a notch 30 and an opening 31 in the sleeve 25. The annular groove 32 communicates with a line 33 located in the shaft of the measuring element 3, which line 33 leads via an injection jet 34 to the gap 35 at the face of the measuring element 3, which gap 35 is exposed to the highest air velocity, between the face of the measuring element 3 and the opposing curved wall of the air induction line 2. The line 33 communicates with the induction tube section 1 upstream of the measuring element 3 via an air opening 54 so that the induction tube pressure prevalent upstream of the measuring element prevails downstream of the fuel apportioning location and acts as a counter pressure. The line 33 can, as not shown here, also communicate with several injection jets 34 disposed in the lower surface of the measuring element 3. An injection slit extending nearly over the entire width of the surface of the measuring element 3 can also serve as the injection jet 34. Furthermore, the injection jet 34 could, although it is not shown here, be supplanted by an injection valve.

The apportionment of the fuel at the sleeve-like apportioning valve 29 takes place at a constant pressure difference. For this reason, a chamber 38 separated from the chamber 17 of the differential pressure valve 18 by a membrane 39 communicates with the induction tube section 1 upstream of the measuring element 3 via an air line 36 represented by a dashed line, so that the same pressure prevails in the chamber 38 as is provided downstream of the control slit 26. The differential pressure valve 18 is urged toward the closed direction by a spring 40 disposed within the chamber 38.

The application of the induction tube pressure prevalent upstream of the measuring element 3 via the air opening 54, in its function as a counter pressure at the apportioning location, has the further advantages, aside from the advantage of preconditioning the apportioned fuel with the air, that, on the one hand, an open injection jet can be utilized, and, on the other hand, that the regulation of a constant differential pressure at the apportioning location can be simplified.

The enrichment of the fuel-air mixture during the warm-up phase of the internal combustion engine takes place by an increase in the differential pressure across the metering location 26, 28. For this purpose, the membrane 39 is engaged in the closure direction of the differential pressure valve 18 to varying degrees by a first bimetallic spring 41 and a second bimetallic spring 42 via an actuating pin 37 and in dependence on the operational temperature of the engine.

The differential pressure valve 18 is embodied as a flat seat valve having a diaphragm 39 as its movable valve member and a fixed valve seat 43 over which fuel can flow into a return line 44 terminating in the fuel container 15. The differential pressure valve series at the same time as a system pressure control valve.

The measuring element 3 is displaced in opposition to the force of a helical spring 47, one of the ends of which is coupled to the sleeve 25, whereas the other end is connected with a stop on the air induction tube. The basic setting of the metering valve 29 may be changed by rotating the bearing axle 7 by means of a lever 48 and an adjustment screw 49 which is supported on a stop 50 attached to the housing.

Figure 4:
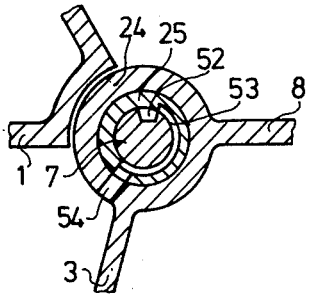
FIG. 4 is a sectional view of the fuel injection mechanism along the line IV—IV of FIG. 2.

As illustrated in FIG. 4, the annular groove 32 is connected via a groove 52 and another annular groove 53 with an air opening 54 which terminates in the induction tube 1 upstream of the measuring element 3. Preferably, the annular groove 53 is so formed as to overlap the groove 52 only when the engine runs at least at idling rpm, i.e., when the injection nozzle 34 is covered by a narrow slit 35. This arrangement prevents supplying an incombustible fuel-air mixture during starting of the engine.

The method of operation of the fuel injection mechanism is as follows: When the internal combustion engine is running, fuel is aspirated from the fuel container 15 by the fuel pump 14 driven by the electric motor 13, and is delivered to the apportioning valve 29 via the line 16, the differential pressure valve 18 and the line 19. The internal combustion engine simultaneously aspirates air via the air induction line 1, by means of which aspirated air a certain deflection from the position at rest is imparted to the measuring element 3. Corresponding to the given deflection of the measuring element 3, the control slit 26 opens more or less, with respect to the control edge 28. The direct control of the apportioning valve by means of the measuring element 3 yields a constant relationship between the aspirated air and the apportioned fuel quantity. The apportionment takes place at a pressure differential held constant, at any given time, by the differential pressure valve 18, wherein the closing force exerted on the membrane 39 and therefore also the desired pressure differential, may be increased in order to permit enrichment of the fuel-air mixture during warm-up of the internal combustion engine. The variation of the closing force exerted on the membrane 39 is provided by the first bimetallic spring 41 and the second bimetallic spring 42. The disposition of two bimetallic springs 41, 42 for the control of the warm-up mixture composition offers the advantage of permitting adaptation of the mixture enrichment during the warm-up phase to the requirements of the engine. Thus, for example, the first bimetallic spring 41 may be so embodied as to engage the diaphragm 39 in the closure direction of the differential pressure valve 18 only at temperatures lying below a predetermined temperature, for example 15° C. in tandem with the second bimetallic spring 42, whereas, for temperatures above approximately 15° C., the first bimetallic spring 41 disengages from the diaphragm 39 so that the further mixture enrichment until the termination of the warm-up phase is controlled exclusively by the second bimetallic spring 42. Accordingly, when the engine is started at a temperature below approximately 15° C., the preliminary fuel-air mixture is substantially enriched and, thereafter, the enrichment factor is rapidly reduced because of the heating of the cylinder walls which prevent the previously occurring condensation of fuel until only the second bimetallic spring 42 controls the enrichment of the mixture up to the end of the warm-up phase.

The injection of the apportioned fuel takes place via the injection jet 34 at the face of the measuring element 3 in the gap 35 between the face of the measuring element 3 and the opposing wall of the section 2, i.e., at the site of the highest flow velocity, in order to attain the most homogeneous fuel-air mixture possible. The contour of the wall of the section 2 lying opposite the path of the face of the measuring element 3 can be fitted to any given desired fuel-air relationship. By disposing the metering valve 29 within the bearing shaft 7, one obtains the advantage of a compact construction of the fuel injection system and the injection through the end face of the measuring element 3 produces shortened fuel lines and a very favorable mixture preparation.

The foregoing relates to merely preferred exemplary embodiments of the invention, the scope of which is defined by the appended claims.

What is claimed is:

1. A fuel supply system for an internal combustion engine, said engine including an intake manifold containing a throttle plate actuated at the discretion of the operator, said fuel supply system comprising:

an airflow metering device, located in said intake manifold upstream of said throttle plate and capable of pivoting motion about a shaft under the influence of air aspirated by the engine;

a fuel metering valve, formed by relatively movable parts of said airflow metering device and of said shaft;

a flat seat differential pressure valve, for maintaining a constant pressure drop across said fuel metering valve, said differential pressure valve having a spring and a movable diaphragm serving as the valve closing chamber, one side of said diaphragm being exposed to the fuel pressure upstream of the fuel metering valve and the other side of said diaphragm being exposed to the intake manifold pressure upstream of said airflow metering device and to the spring force; and means for changing the differential pressure exerted by said differential pressure valve in dependence on engine variables, said means for changing the differential pressure exerted by said differential pressure valve comprising: first and second bimetallic members; and means connecting said bimetallic members to the other side of said diaphragm for exerting closing forces against said diaphragm below a predetermined engine temperature.

2. A fuel supply system as defined in claim 1, wherein said first bimetallic member is constrained to disengage from said diaphragm at a first temperature and said second bimetallic member is constrained to disengage from said diaphragm at a second and higher temperature, said second temperature being substantially the normal engine operating temperature.

* * * * *